United States Patent [19]

Ray

[11] Patent Number: 4,494,752

[45] Date of Patent: Jan. 22, 1985

[54] RACKET STRINGER AND TENSIONER

[76] Inventor: Lynn L. Ray, P.O. Box 3464, San Diego, Calif. 92103

[21] Appl. No.: 484,071

[22] Filed: Apr. 11, 1983

[51] Int. Cl.[3] ..... A63B 51/14

[52] U.S. Cl. ..... 273/73 A; 242/155 R; 242/151; 29/241; 29/433

[58] Field of Search ..... 273/73 A, 73 B; 242/155 R, 151, 152; 29/241, 433

[56] References Cited

U.S. PATENT DOCUMENTS 2,599,390 6/1952 Huse ..... 242/151

3,441,275 4/1969 Held ..... 273/73 A

*Primary Examiner*—Richard C. Pinkham

*Assistant Examiner*—Matthew L. Schneider

*Attorney, Agent, or Firm*—Charmasson & Holz

[57] ABSTRACT

A device for stringing tennis rackets and the like, and for tightening sagging strings, which, in the preferred embodiment comprises three rows of rollers clamped around two adjacent strings inside the racket frame. Each row of rollers is attached to the end of a lever. The levers are rockingly linked together so that the strings can be gripped and released between the rollers as desired. The rollers are mechanically coupled to each other by way of a series of intermeshing spur gears. A crank, attached to the gears, drives the rollers and allows adjacent rollers to rotate in opposite directions. Thus, two strings in gripping engagement with the three rows of rollers are pulled in opposite directions as the crank is turned.

11 Claims, 11 Drawing Figures

RACKET STRINGER AND TENSIONER

BACKGROUND OF THE INVENTION

The invention is in the field of wire pulling and tightening devices, and more particularly methods and devices for stringing and tightening the strings of tennis rackets and the like.

The conventional method of stringing a tennis racket utilizes a jig which supports the racket frame in a horizontal plane convenient to the operator. Two anchor bars extend beneath the plane of the racket frame in the direction the tightened strings will run. A first clamp engageable on these anchor bars is used to grip a string interiorly of the racket frame. The operator then pulls the string through two string holes on opposite sides of the racket so that there is now a string adjacent the gripped string. A tensioning arm exterior to the racket frame is then used to tighten this string, which is in turn gripped by another clamp. The operation is repeated, alternating the clamps until the entire racket is strung.

When laying down the second grid over the first, naturally the strings must be woven through the first grid. This is done manually and it is a labor-intensive process. Even the most skilled stringers can only string a few rackets in an hour. Present racket string machines comprise only a mounting frame, string clamps and string pulling levers. They can often be used on only one type and size of racket. There is a need for a better type of device which would expedite and simplify the stringing process.

Another important point in the background of this invention is the current absence of any way to tighten sagging strings of a racket without completely re-stringing it. Oftentimes string tension of a racket dissipates long before the strings are worn out. Nevertheless, under present methods the strings are cut off and the racket is re-strung. There is a real need for a device that could tighten the strings on a racket without re-stringing it.

SUMMARY OF THE INVENTION

One object of the invention is to provide a racket string tensioner which engages and tensions the string within the racket frame, permitting re-tensioning without re-stringing.

Another object of this invention is to provide a string tensioning device which can engage and tighten the strings independent of any external anchoring point.

Another object of this invention is to provide a tensioner which combines the clamping and tensioning functions in one device, replacing the tensioner and the clamp previously used.

Another object of the invention is to provide a string tensioner which can be used irrespective of racket size, and in particular can be used with the currently popular oversized rackets.

These objects and other objects are achieved by the string tightener or tensioner having rollers engaged on the opposite sides of a string which are rotated to tension the string. In the preferred embodiment, the rollers are provided in three rows to engage two adjacent strings and pull them in opposite directions. This has the effect of utilizing a tensioned string as an anchor point to tension an adjacent string.

In the preferred embodiment, the above-mentioned three rows are each mounted on a separate member, with the outer roller rows being pivotally connected to the central roller row along axes parallel to the length of string to be tensioned. The outer rows are biased against the central row, and can be separated from it by squeezing handles extending on the opposite sides of the pivot point from the rollers.

Adjacent rows of strings can thus be engaged by the rollers, the handles are then released, permitting the springs in the handles to force the rollers into frictional contact with the strings. A crank is then rotated to turn the rollers in the suitable direction, through a spur gear mechanism.

In a modification, two rows of rollers are used instead of three, thus requiring an external anchor point. This anchor point is the same anchor point used with conventional string tighteners, a rod lying in the frame holding jig beneath the racket frame. This embodiment loses the advantage of independence from stringing jigs, but nevertheless replaces the tensioner required on conventional stringing systems.

DETAILED DESCRIPTION OF THE PREFERRED EMBODIMENT OF THE INVENTION

Figure 1:
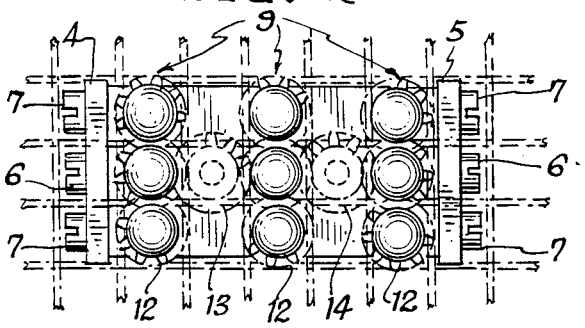
FIG. 1 is a top plan view of the tightener illustrating the rollers and their gear inter-engagements.
Figure 2:
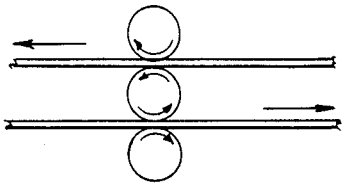
FIG. 2 is a diagrammatic illustration of roller action, pulling adjacent strings in opposite directions.
Figure 4:
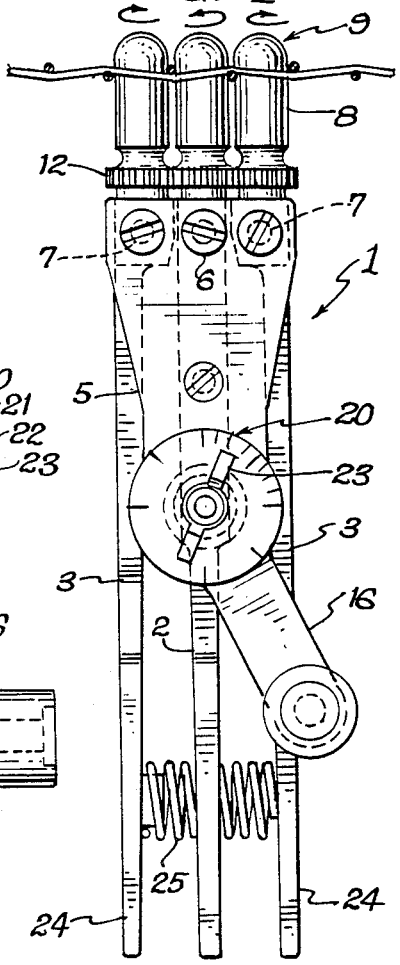
FIG. 4 is an elevation view taken from the right side of FIG. 3.
Figure 3:
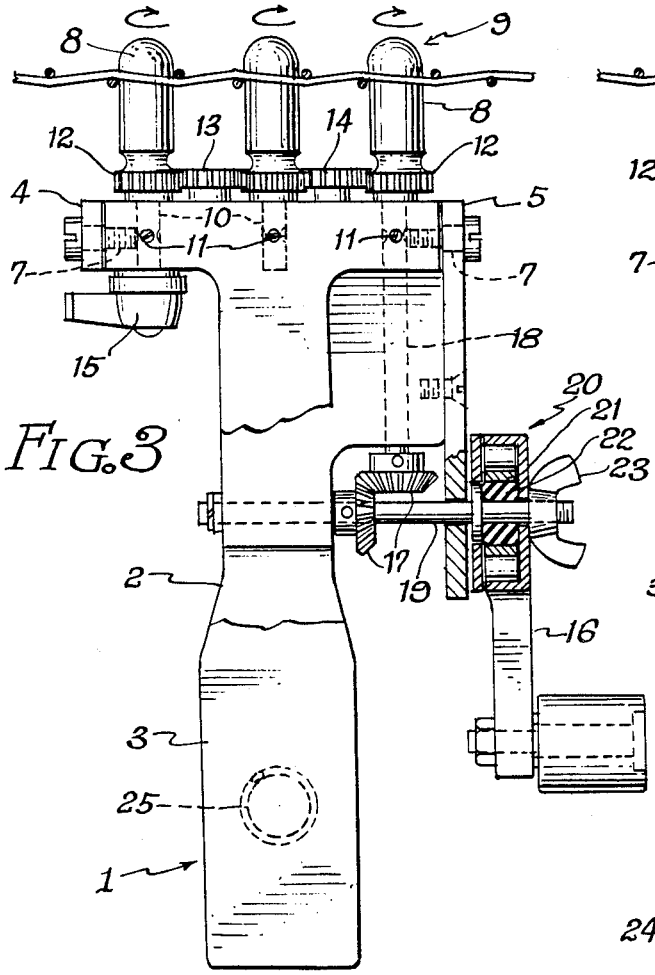
FIG. 3 is a side elevation view with portions cut away illustrating the drive mechanism.

In the first embodiment of the invention illustrated in FIGS. 1–5, the tightener has a frame 1, comprised of a central roller mounting lever 2 and outer roller mounting levers 3, on opposite sides of the central lever 2. Endplates 4 and 5, bolted to the central lever 2 at 6, mount bolt retainer shafts 7 which pass through the upper portions of the outer levers 3, making the outer levers rock about these shafts relative to the central lever 2.

Mounted in the heads of each of the levers is a roller assembly of three rollers 8 in a row. These are two outer rows and one central row, which together define three two-string drive groups 9.

The rollers are each rounded or otherwise tapered on top to act as pilots for easy engagement with the strings. Each roller has a small mounting shaft 10 inserted in a bore within the respective lever, where it is retained by retainer screws 11 or the like. Each roller also has a spur gear 12 at its base, so that each roller in a particular drive group is positively linked with the other rollers in that group.

Between groups are reverse drive gears 13 and 14, which can be mounted to the central lever 2 in the same manner as the rollers are mounted.

Figure 7:
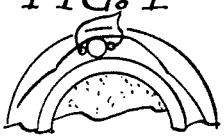
FIG. 7 diagrammatically illustrates a reversible one-way clutch utilizable in the drive mechanism.
Figure 8:
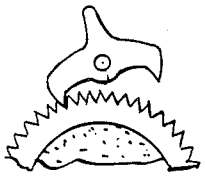
FIG. 8 illustrates an alternative to the method of FIG. 7, utilizing a reversible ratchet gear.

The balance of the drive system comprises a reversible unidirectional drive control 15, which could be a ratchet or a clutch-type mechanism shown respectively in FIGS. 8 and 7, or any other suitable reverse mechanism being produced. In the illustrated embodiment, it acts on the leftmost roller in the central row. The rightmost roller of the central row is driven by crank 16 through the bevel gears 17 and shafts 18 in the drive train clearly visible by reference to FIG. 3. The right endplate 5 extends sufficiently far down to provide the outer mount for the crank shaft 16.

There is preferably mounted somewhere in the drive mechanism a tension control device which either allows the mechanism to slip after a certain tension is reached, or which at least provides a visual indication of the tension level. There is a need to tension the strings at a uniform tension, for obvious reasons. In the illustrated embodiment this function is provided by a slipping clutch 20. The outer housing of this clutch, including the cylinder 21, is mounted as part of the crank and moves therewith. Inside the housing is a tough, compressible ring 22 which is fixed to the shaft 19. By torquing down the wing nut 23, the mass of the compressible ring 22 expands against the cylinder 21, causing the tension to be increasingly great. The illustrated slip-clutch is more diagrammatical than not, as any of a variety of torque indicating or controlling devices could be used to insure the string tensioning is uniform. Each lever extends downward to form handles 24, and between these handles are mounted springs 25. The springs force the handles apart, thereby forcing the rollers together. This action is best seen by reference to FIG. 5.

Figure 5:
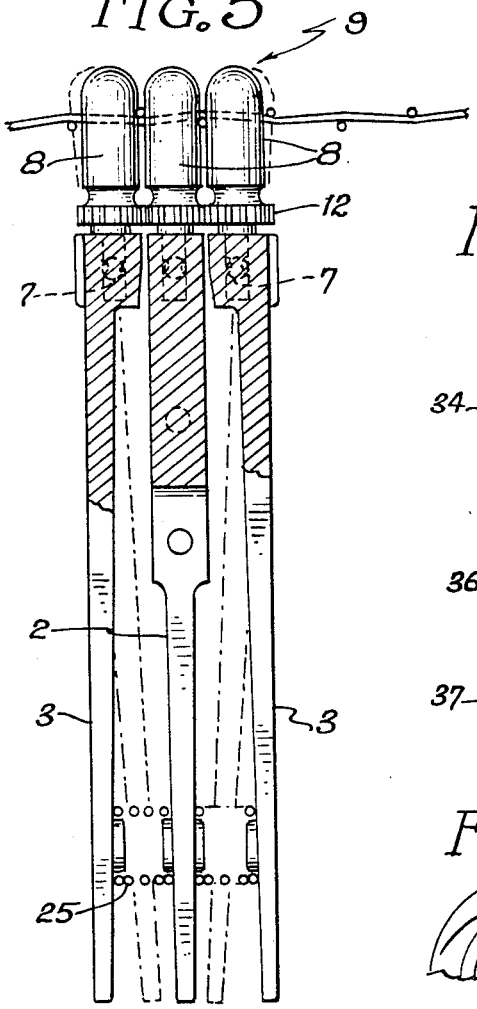
FIG. 5 is an elevation view of the opposite side of the tightener from FIG. 4, illustrating the movement of the rollers and handles as the latter are compressed.

Because the rollers must move apart slightly as shown in FIG. 5, all of the gears illustrated in FIG. 1 must have teeth sufficiently long to accommodate this spread. Also, obviously the springs must be of such strength as to enable the roller to sufficiently purchase the string to tighten it to its proper tension without slipping. Theoretically a single roller drive group 9 could be used. It is preferable to use two or three roller drive groups as shown in order to spread the pressure and avoid flattening the string.

Figure 9:
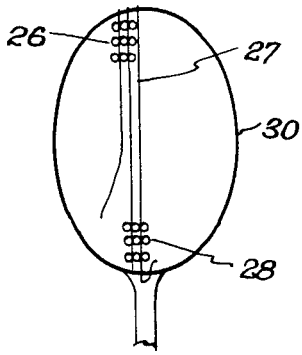
FIGS. 9–11 illustrate the method, utilizing the tightener of the first embodiment, for stringing the first string grid in a racket frame.
Figure 10:
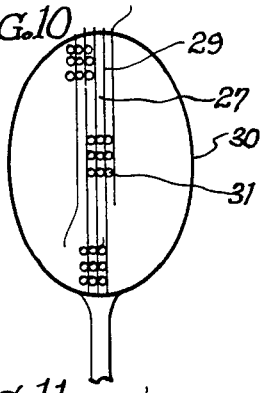
Figure 11:
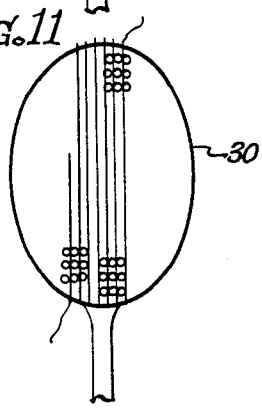

Operation of the tightener to string a racket is shown in FIGS. 9–11. This method utilizes three of the tensioners, although two tensioners and two clamps could be used, but not quite as simply.

First, a tightener 26 is used to engage two adjacent strings threaded slightly to the right or left of the center line of the racket. The first string grid must be tightened while avoiding excessive tension on one side of the racket which would cause warping. Therefore, one would start to the left of the center line as shown in FIG. 9, then work part of the way to the right, return to the left side, and then finish off the right.

Once the tightener 26 is in place, the next string 27 is pulled with a second tightener 28 at the opposite end of the racket. Actually, other than for clearance of the rollers between tighteners, it is not particularly material how high or low on the string the roller is engaged.

Once tightener 28 is in place, string 27 is pulled, and the next string 29 is run through the appropriate string holes in the frame 30. Then the third tightener 31 is put in position as shown in FIG. 10 to tighten string 29, and so forth. At this point, the string that has already been tensioned is held in place by the first and third tighteners 26 and 31, so that the middle tightener 28 can be removed. It can now be used to leap-frog in this fashion either to the left or to the right. It is preferable to move to the right about half of the way to the edge, and then work on the left to finish all stringing on that side before doing the right side.

When the stringing of the first grid direction has been completed, at least one end of the string is tied off in a process that is not part of this invention, using for example the tensioner of an existing stringing machine, or by other suitable means. The other end can either be used to run the other direction to finish the grid, or likewise tie it off, with a new string being used for strings running the other direction.

Thus, not only has the necessity for a fixed racket frame jig-type stringer been eliminated, but also there is provided a considerably faster way of stringing rackets.

Figure 6:
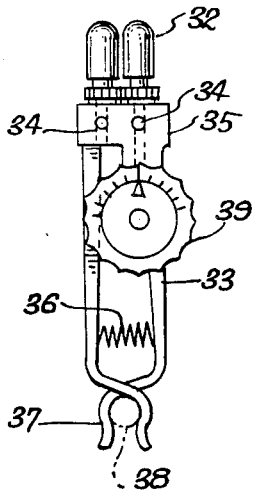
FIG. 6 is a diagrammatic illustration of a modification of the tightener wherein only two roller rows are used, and the tightener engages on the bar of a conventional racket stringer.

In a modification of the string tightener shown in FIG. 6, the roller frame is used in conjunction with an existing stringing machine, or one similar in principal to existing machines. Rather than gripping two strings to provide an anchor for tensioning one of them against the other, this embodiment utilizes only two rows of preferably three rollers 32. These rollers are each mounted on a bar 33 of the roller frame, with these bars being pivotally engaged at 34 on endplates 35. Spring 36 holds the handles of the bar apart, and presses the rollers together, while the reverse clip 37 defined at the bottom of the handles engages the bar 38 which is part of the racket mounting jig. Reference is made to the Ektelon stringing machine currently in use, and other similar devices using some type of bar 38 which is moved across the racket as it is strung, with the force being delivered to the bar in the direction of the string being tensioned. A tension regulator 39 of the type previously described is indicated.

The second embodiment could be used in a fashion similar to the way rackets are conventionally strung, except that the tensioner included in conventional rackets would no longer be needed.

Clearly many modifications of the structure shown could be made without deviating from the spirit of the invention. Roller rows could be longer or even shorter, the crank could be replaced with a ratcheting lever or any other drive element, and any kind of tension release mechanism 20 could be used. At the heart of the invention is the utilization of rollers to directly engage strings inside the perimeter of the racket frame and tighten same, substantially independently of outside tensioning mechanisms.

While the preferred embodiment of the invention has been described, other modifications may be made thereto and other embodiments may be devised within the spirit of the invention and the scope of the appended claims.

What is claimed is:

1. A string tightener for tensioning strings across a frame which comprises:

two levers each having a roller assembly at one end thereof;

means for rockingly linking said levers together near said ends;

resilient means for biasing said two roller assemblies toward each other;

said roller assemblies and said means for rockingly linking being shaped and dimensioned to grippingly purchase a string between said two roller assemblies; and means for driving said roller assemblies in respective opposite rotational directions, comprising a drive mechanism positively coupled to one of said roller assemblies and means for reversibly linking said one roller assembly to said other roller assembly for driving said assemblies in opposite directions.

2. The string tightener claimed in claim 1 wherein:

each of said roller assemblies comprises a row of at least two rollers;

said means for driving comprises a spur gear axially associated with each roller, said spur gear being mechanically coupled to at least one other spur gear associated with another roller so that all rollers within an assembly rotate in the same direction; and said drive mechanism being coupled to one of said rollers and said associated spur gear.

3. A string tightener for tensioning strings across a frame which comprises:

three layers comprising a central lever and outer levers on opposite sides of the central lever, each lever having a roller assembly mounted at one end thereof;

means for rockingly linking said outer levers to said central lever near said ends;

resilient means for biasing said outer lever roller assemblies toward the central lever roller assembly;

said roller assemblies and said means for rockingly linking being shaped and dimensioned to grippingly purchase two adjacent strings between said outer and central roller assemblies; and means for driving adjacent roller assemblies in opposite rotational directions.

4. A string tightener claimed in claim 3 wherein each of said roller assemblies comprises:

a row of at least two rollers;

said means for driving comprises a spur gear axially associated with each roller, said spur gear being mechanically coupled to at least one other spur gear associated with another roller, so that all rollers within an assembly rotate in the same direction; and which further comprises a drive mechanism coupled to one of said rollers and associated spur gear.

5. The string tightener claimed in claim 4 wherein one spur gear in each roller assembly engages one spur gear in the adjacent roller assembly;

said mutually engaging spur gear having teeth shaped and dimensioned to remain intermeshed when the roller assemblies are partially pulled apart by rocking movement of the levers against one another in order to purchase a string therebetween.

6. The string tightener claimed in claim 5 wherein said means for rockingly linking comprises:

a centrally mounted lever having cross members extending on each side thereof perpendicularly to the direction of said rows and below said roller assemblies; and a rocking shaft spanning said cross members on each side of said centrally mounted lever and engaging one of said other levers.

7. The string tightener claimed in claim 6 wherein the ends of said levers opposite to said roller assemblies define handles extending adjacently to one another; and said means for biasing comprises at least one spring compressed between two of said handles.

8. The string tightener claimed in claim 7 wherein said drive mechanism comprises a one-directional rotation control.

9. The string tightener claimed in claim 8 wherein said one-directional rotation control comprises a reversible ratchet.

10. The string tightener claimed in claim 9 wherein said drive mechanism comprises means for limiting the driving force applied to said roller assemblies.

11. The string tightener claimed in claim 10 wherein:

each roller assembly comprises three rollers;

each roller in the centrally located roller assembly has an axially connected spur gear which is coupled to a spur gear axially connected to a roller in the laterally located roller assemblies and to one of two intermediary spur gears coupling the spur gears of said centrally located roller assemblies into a common rotational direction; and said dr've mechanism comprises a crank acting upon one axle of one of the rollers in the centrally located roller assembly.

* * * * *